US008068002B2

(12) United States Patent
Shen

(10) Patent No.: US 8,068,002 B2
(45) Date of Patent: Nov. 29, 2011

(54) COUPLED ELECTROMECHANICAL RELAY AND METHOD OF OPERATING SAME

(75) Inventor: Jun Shen, Phoenix, AZ (US)

(73) Assignee: Magvention (Suzhou), Ltd., Suzhou (CN)

( * ) Notice: Subject to any disclaimer, the term of this patent is extended or adjusted under 35 U.S.C. 154(b) by 249 days.

(21) Appl. No.: 12/427,614

(22) Filed: Apr. 21, 2009

(65) Prior Publication Data

US 2009/0261927 A1 Oct. 22, 2009

Related U.S. Application Data

(60) Provisional application No. 61/046,894, filed on Apr. 22, 2008.

(51) Int. Cl.
*H01H 51/22* (2006.01)
*H01H 57/00* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,398,011 A 3/1995 Kimura et al.
5,475,353 A 12/1995 Roshen et al.
5,703,550 A 12/1997 Pawlak et al.
5,818,316 A 10/1998 Shen et al.
5,847,631 A 12/1998 Taylor et al.
5,945,898 A 8/1999 Judy et al.
5,994,986 A * 11/1999 Takahashi ..... 335/78
6,084,281 A 7/2000 Fullin et al.
6,094,116 A 7/2000 Tai et al.
6,124,650 A 9/2000 Bishop et al.
6,124,771 A * 9/2000 Kim et al. ..... 335/4
6,143,997 A 11/2000 Feng et al.
6,469,602 B2 10/2002 Ruan et al.
6,469,603 B1 10/2002 Ruan et al.
6,492,887 B1 * 12/2002 Diem et al. ..... 335/78
6,538,540 B2 * 3/2003 Oberndorfer et al. ..... 335/78
6,633,158 B1 * 10/2003 Shen et al. ..... 324/207.26
6,633,212 B1 * 10/2003 Ruan et al. ..... 335/78
6,639,493 B2 * 10/2003 Shen et al. ..... 335/78
6,750,745 B1 * 6/2004 Wei et al. ..... 335/78
6,794,965 B2 * 9/2004 Shen et al. ..... 335/78
7,023,304 B2 * 4/2006 Shen et al. ..... 335/78
7,049,904 B2 * 5/2006 Shin ..... 333/105
7,151,426 B2 * 12/2006 Stafford et al. ..... 335/78
7,301,334 B2 * 11/2007 Shen et al. ..... 324/207.26
7,482,899 B2 1/2009 Shen et al.
2002/0140533 A1 * 10/2002 Miyazaki et al. ..... 335/78

* cited by examiner

*Primary Examiner* — Elvin G Enad
*Assistant Examiner* — Alexander Talpalatskiy

(57) ABSTRACT

An electromechanical relay employing a movable first permanent magnet and a nearby third electromagnet is disclosed. The movable first magnet is permanently magnetized and has at least a first end. The third electromagnet, when energized, produces a third magnetic field which is primarily perpendicular to the magnetization direction of the first movable magnet and exerts a magnetic torque on the first magnet to force the first magnet to rotate and closes an electrical conduction path at the first end. Changing the direction of the electrical current in the third electromagnet changes the direction of the third magnetic field and thus the direction of the magnetic torque on the first magnet, and causes the first magnet to rotate in an opposite direction and opens the electrical conduction path at the first end. Multiple magnets can be stacked together to form multi-pole-multi-throw relays. Latching and non-latching types of relays can be formed by appropriately using soft and permanent magnets as various components.

20 Claims, 3 Drawing Sheets

Front view.

Front view.

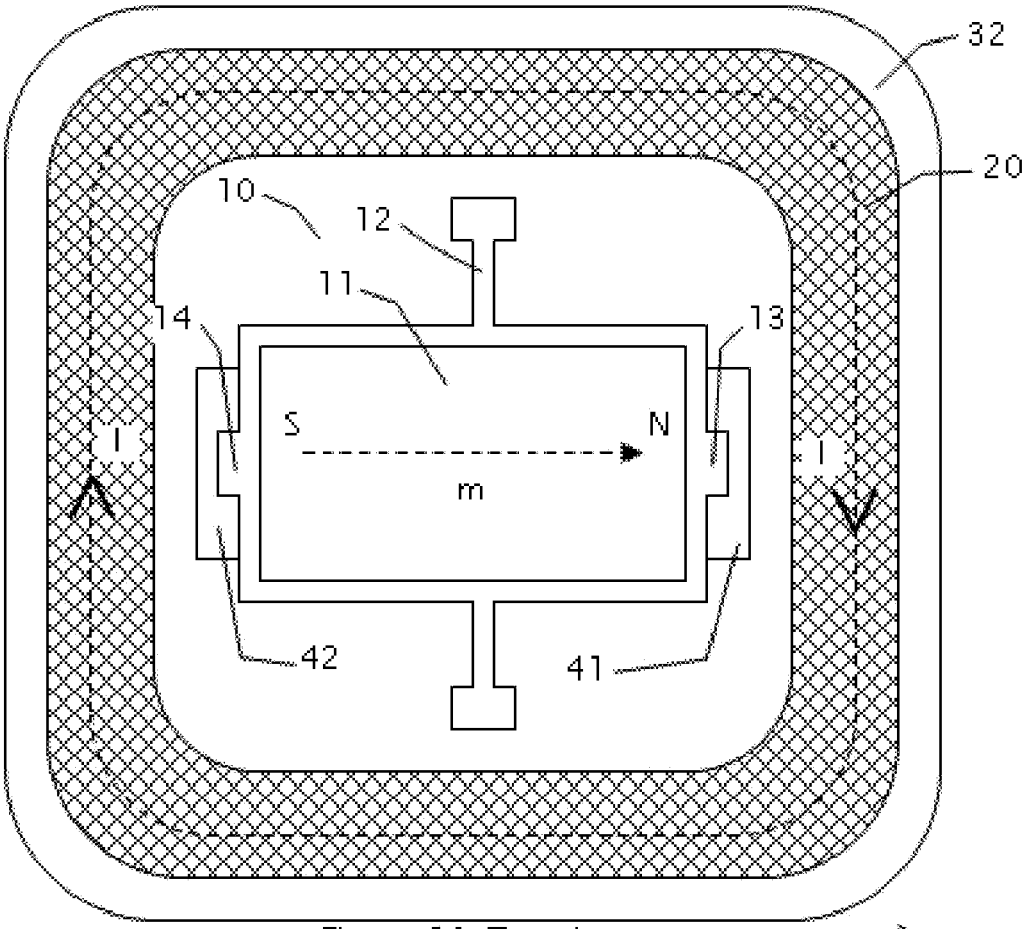
Figure 1A. Top view.
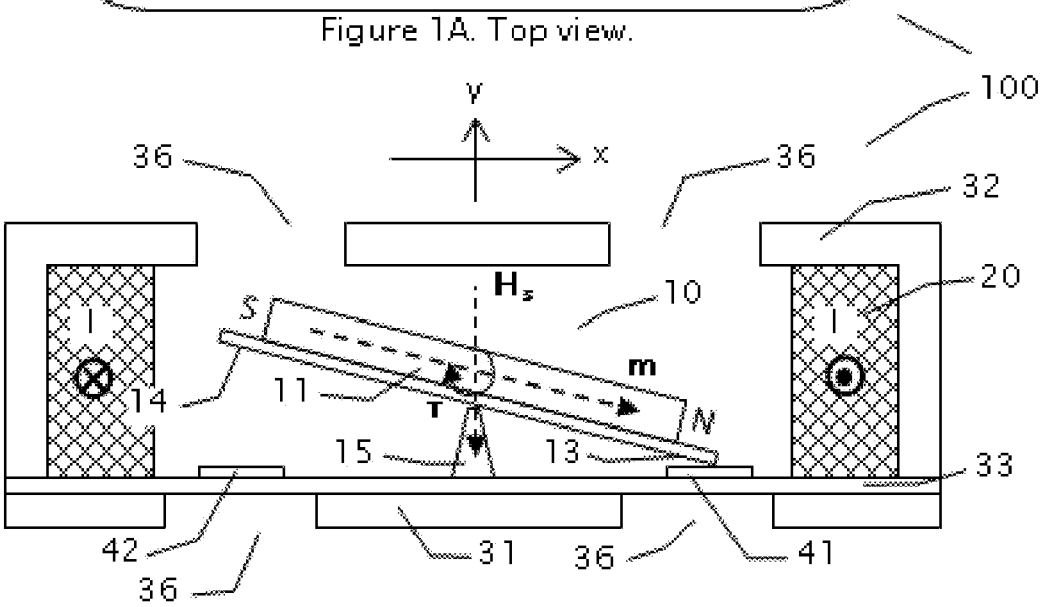
Figure 1B. Front view.

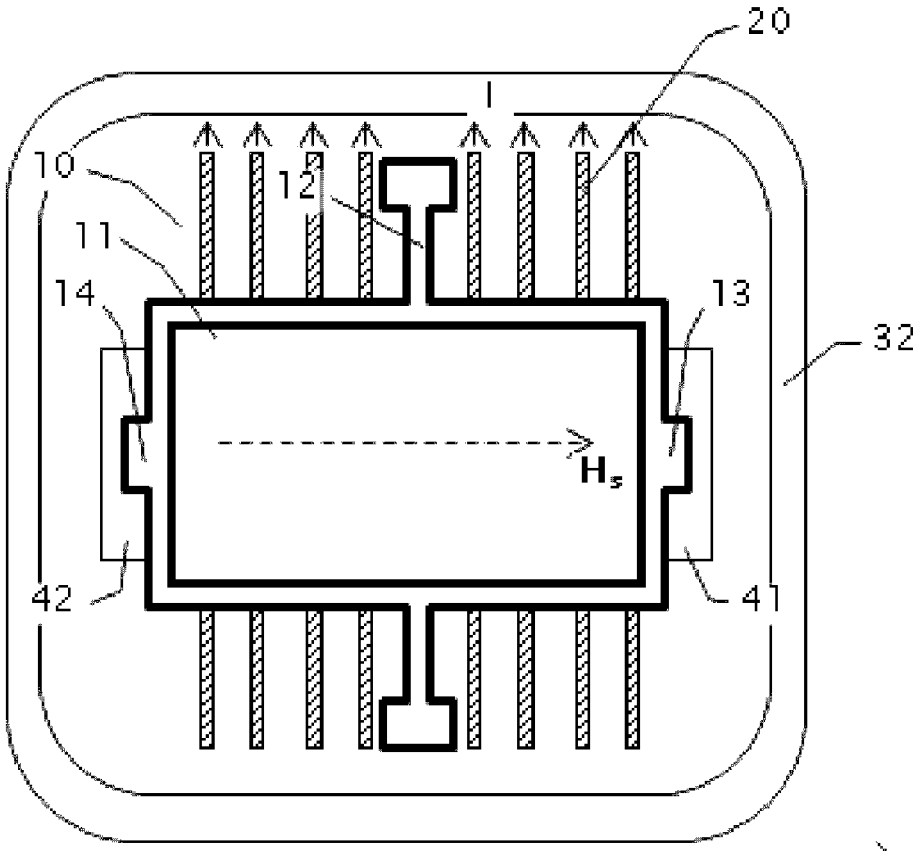
Figure 2A. Top view.
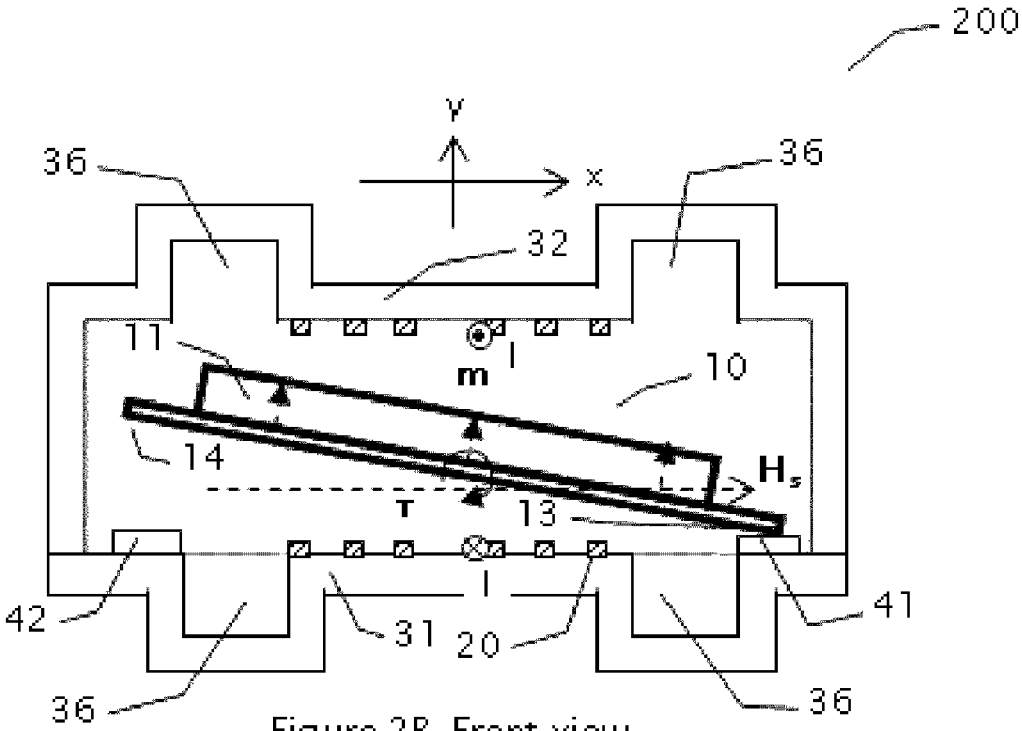
Figure 2B. Front view.

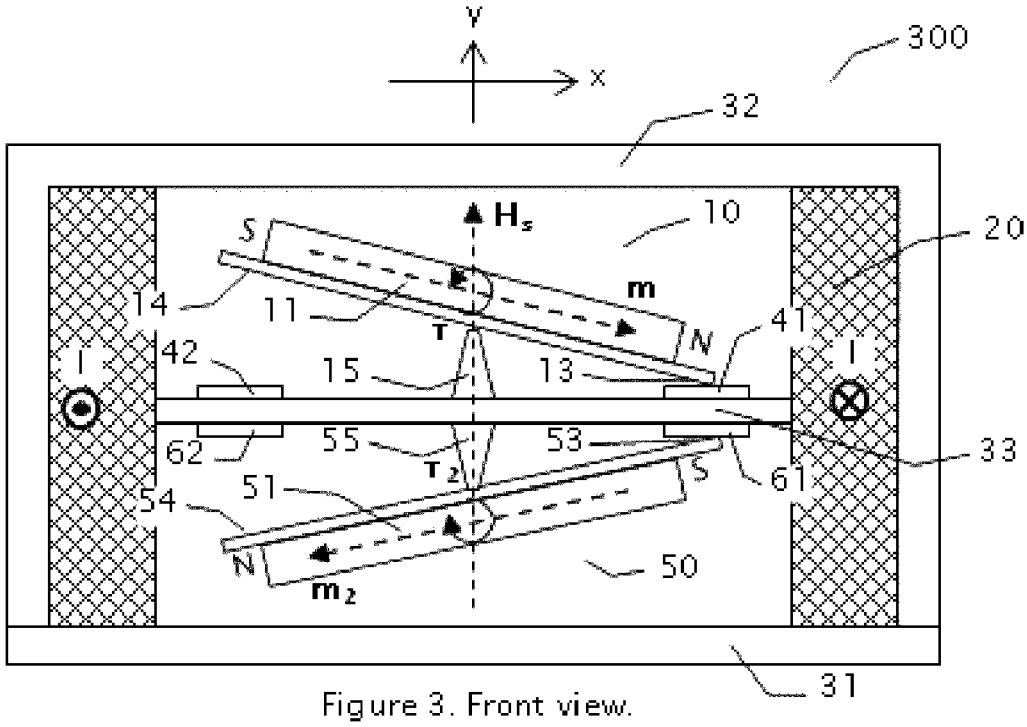
Figure 3. Front view.
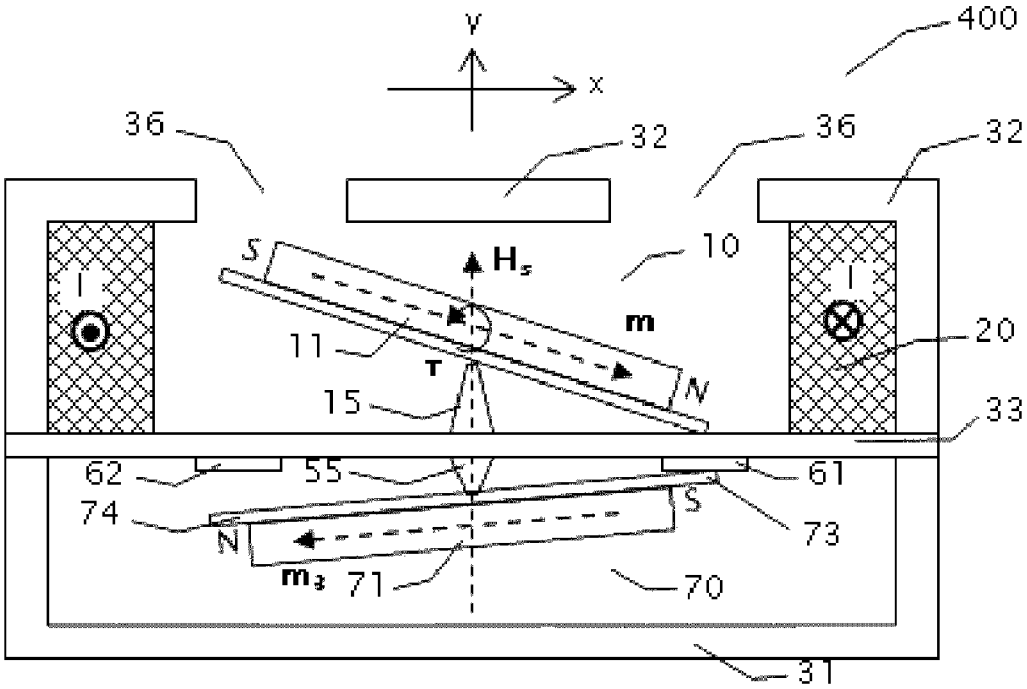
Figure 4. Front view.

COUPLED ELECTROMECHANICAL RELAY AND METHOD OF OPERATING SAME

CROSS REFERENCE TO RELATED APPLICATIONS

This patent application claims the benefit of U.S. Provisional Patent Application Ser. No. 61/046,894, filed on Apr. 22, 2008. This patent application is related to U.S. application Ser. No. 12/268,936, filed on Nov. 11, 2008, which is a divisional of U.S. Pat. No. 7,482,899 B2, issued on Jan. 27, 2009.

FIELD OF THE INVENTION

The present invention relates to relays. More specifically, the present invention relates to coupled electromechanical relays and to methods of operating and formulating electromechanical relays.

BACKGROUND OF THE INVENTION

Relays are electromechanical switches operated by a flow of electricity in one circuit and controlling the flow of electricity in another circuit. A typical relay includes an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position.

Latching relays are the types of relays which can maintain closed and open contact positions without energizing an electromagnet. Short current pulses are used to temporally energize the electromagnet and switch the relay from one contact position to the other. An important advantage of latching relays is that they do not consume power (actually they do not need a power supply) in the quiescent state.

Conventional electromechanical relays have traditionally been fabricated one at a time, by either manual or automated processes. The individual relays produced by such an "assembly-line" type process generally have relatively complicated structures and exhibit high unit-to-unit variability and high unit cost. Conventional electromechanical relays are also relatively large when compared to other electronic components. Size becomes an increasing concern as the packaging density of electronic devices continues to increase.

Two forms of conventional latching relays are described in the Engineers' Relay Handbook (Page 3-24, Ref. [1]). A permanent magnet supplies flux to either of two permeable paths that can be completed by an armature. To transfer the armature and its associated contacts from one position to the other requires energizing current through the electromagnetic coil using the correct polarity. One drawback of these traditional latching relay designs is that they require the coil to generate a relatively large reversing magnetic field in order to transfer the armature from one position to the other. This requirement mandates a large number of wire windings for the coil, making the coil size large and impossible or very difficult to fabricate other than using conventional winding methods.

U.S. Pat. No. 5,818,316 issued to Shen et al. described a switch having two magnetizable conductors in which the first conductor is permanently magnetized and the second conductor is switchable in response to a magnetic field applied thereto.

U.S. Pat. No. 6,469,602 B2 issued to Ruan et al. described a relay operated by providing a cantilever sensitive to magnetic fields such that the cantilever exhibits a first state corresponding to the open state of the relay and a second state corresponding to the closed state of the relay.

U.S. Pat. No. 6,124,650 issued to Bishop et al. disclosed a relay employing square-loop latchable magnetic material having a magnetization direction capable of being changed in response to exposure to an external magnetic field. The magnetic field is created by a conductor assembly. The attractive or repulsive force between the magnetic poles keeps the switch in the closed or open state.

Each of the aforementioned relays, though providing a unique approach to make latching electromechanical relays, has drawbacks and limitations. Some of them may require large current for switching, and some may require precise relative placement of individual components. These drawbacks and limitations can make manufacturing difficult and costly, and hinder their value in practical applications.

Accordingly, it would be highly desirable to provide an easily switchable electromechanical relay which is also simple and easy to manufacture and use.

It is a purpose of the present invention to provide a new and improved electromechanical relay which can be easily configured as latching or non-latching types.

It is another purpose of the present invention to provide a new and improved multi-pole multi-throw electromechanical relay.

SUMMARY OF THE INVENTION

The above problems and others are at least partially solved and the above purposes and others are realized in a relay comprising a movable first magnet and a nearby third electromagnet (e.g., a coil or solenoid). The movable first magnet is permanently magnetized, including but not limited to being magnetized primarily along its long (horizontal) axis, and has at least a first end. The third electromagnet, when energized, produces a third magnetic field which is primarily perpendicular to the magnetization direction of the first movable magnet and exerts a magnetic torque on the first magnet to force the first magnet to rotate and closes an electrical conduction path at the first end. Changing the direction of the electrical current in the third electromagnet changes the direction of the third magnetic field and thus the direction of the magnetic torque on the first magnet, and causes the first magnet to rotate in an opposite direction and opens the electrical conduction path at the first end. Multiple magnets can be stacked together to form multi-pole-multi-throw relays. Latching and non-latching types of relays can be formed by appropriately using soft and permanent magnets as various components.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 1A is a top view of an exemplary embodiment of an electromechanical relay;

FIG. 1B is a front view of an exemplary embodiment of an electromechanical relay;

FIG. 2A is a top view of another exemplary embodiment of an electromechanical relay;

FIG. 2B is a front view of another exemplary embodiment of an electromechanical relay;

FIG. 3 is a front view of an exemplary embodiment of another electromechanical relay;

FIG. 4 is a front view of another exemplary embodiment of an electromechanical relay.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical latching relays may be spatially arranged in any orientation or manner. Arrays of these relays can also be formed by connecting them in appropriate ways and with appropriate devices.

FIGS. 1A and 1B show top and front views, respectively, of an electromechanical relay. With reference to FIGS. 1A and 1B, an exemplary electromechanical relay 100 suitably comprises a movable cantilever 10, a coil 20, soft magnetic layers 31 and 32 with suitable openings 36, electrical contacts 41 and 42, and a substrate 33.

Movable cantilever 10 comprises a permanent (hard) magnetic layer 11 (first magnet), flexure spring and support 12, a pivot 15, and electrical contacts 13 and 14. Magnetic layer 11 is permanently magnetized (with a magnetic moment m) primarily along its long axis (e.g., predominantly along the positive x-axis when it lies leveled). Other magnetization orientation of magnetic layer 11 is also possible as long as it achieves the function and purpose of this invention. Cantilever 10 has a first (right) end associated with the first (right) end of first magnet 11 and contact 13, and has a second (left) end associated with the second (left) end of first magnet 11 and contact 14. Magnetic layer 11 can be any type of hard magnetic material that can retain a remnant magnetization in the absence of an external magnetic field and its remnant magnetization cannot be easily demagnetized. In an exemplary embodiment, magnetic layer 11 is a thin SmCo permanent magnet with an approximate remnant magnetization ($B_r=\mu_0 M$) of about 1 T through its thickness (predominantly along the x-axis). Other possible hard magnetic materials are, for example, NdFeB, AlNiCo, Ceramic magnets (made of Barium and Strontium Ferrite), CoPtP alloy, and others, that can maintain a remnant magnetization ($B_r=\mu_0 M$) from about 0.001 T (10 Gauss) to above 1 T ($10^4$ Gauss), with coercivity ($H_c$) from about $7.96\times10^2$ A/m (10 Oe) to above $7.96\times10^5$ A/m ($10^4$ Oe). Flexure spring and support 12 can be any flexible material that on one hand supports cantilever 10 and on the other allows cantilever 10 to be able to move and rotate. Flexure spring and support can be made of metal layers (such as Beryllium Copper, Ni, stainless steel, etc.), or non-metal layers (such as polyimide, Si, $Si_3Ni_4$, etc.). The flexibility of the flexure spring can be adjusted by its thickness, width, length, shape, and elasticity, etc. Pivot 15 further supports the cantilever to maintain a gap between cantilever 11 and soft magnetic layer 31. Pivot 15 can be placed on the top of cantilever 11 to maintain a gap between cantilever 11 and soft magnetic layer 32. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of the cantilever by electroplating, deposition, welding, lamination, or any other suitable means. Flexure spring and support 12 and electrical contacts 13 and 14 can be formed by either using one process and the same material, or by using multiple processes, multiple layers, and different materials. When cantilever 10 rotates and its two ends move up or down, electrical contact 13 or 14 either makes or breaks the electrical connection with the bottom contact 41 or 42. Optional insulating layers (not shown) can be placed between the conducting layers to isolate electrical signals in some cases.

Coil 20 (third electromagnet) is formed by having multiple windings of conducting wires around cantilever 10. The conducting wires can be any conducting materials such as Cu, Al, Au, or others. The windings can be formed by either winding the conducting wires around a bobbin, or by electroplating, deposition, etching, laser forming, or other means used in electronics industry (e.g., semiconductor integrated circuits, printed circuit boards, etc.). One purpose of coil 20 in relay 100, when energized, can be to provide a third vertical (y-axis) magnetic field ($H_s$) so that a magnetic torque ($\tau=\mu_0 m\times H_s$) can be created on cantilever 10. Because magnetic moment m is fixed, the direction and magnitude of the torque depends on the direction and magnitude of the current in coil 20. This arrangement provides a means for external electronic control of the relay switching between different states, as to be explained in detail below.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. Soft magnetic layers 31 and 32 can form a closed magnetic circuit and enhance the coil-induced magnetic flux density (third vertical magnetic field $H_s$) in the cantilever region. Soft magnetic layers 31 and 32 can also cause an attractive force between the pole of hard magnetic layer 11 and the induced local opposite magnetic pole of the soft magnetic layer so that a stable contact force can be maintained between electrical contact 13 (or 14) and electrical contact 41 (or 42) when the latching feature is desired. Soft magnetic layers 31 and 32 can be used to confine the magnetic field inside the cavity enclosed by soft magnetic layers 31 and 32 so that the magnetic interference between adjacent devices can be eliminated or reduced. Openings 36 can be suitably formed in soft magnetic layers 31 and 31 to reduce the attractive force between the magnetic poles of magnet 11 and the soft magnetic layers 31 and 32.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on a substrate 33 by electroplating, deposition, welding, lamination, or any other suitable means. Optional insulating layers (not shown) can be placed between the conducting layers to isolate electrical signals in some cases.

Transmission-line types of contacts and metal traces can also be suitably designed and formed for high performance radio-frequency applications.

An electromagnet 20, when energized, produces a third magnetic field which can be primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. Changing the direction of the electrical current in third electromagnet 20 changes the direction of the third magnetic field and thus the direction of the magnetic torque on first magnet 11, and causes first magnet 11 and cantilever 10 to rotate in an opposite direction and opens the electrical conduction path at one end (e.g., first end) of cantilever 10 and closes the electrical conduction path at the other end (e.g., second end).

With continued reference to FIGS. 1A and 1B, first magnet 11 is permanently magnetized horizontally (along positive x-axis) with a magnetization moment m. Cantilever 10 can have three basic stable positions: (a) the first (right) end down (as shown); (b) the second (left) end down; and (c) neutral (leveled) position. When a current passes through coil 20 (third electromagnet) as shown in FIG. 1B (going into (circle with a cross) the paper on the left side and out (circle with a dot) from the paper on the right), a perpendicular third magnetic field ($H_s$, pointing downward in this case) about first magnet 11 is produced. The third magnetic field $H_s$ interacts with first magnet 11 and exerts a magnetic torque ($\tau=\mu_0 m\times H_s$) on first magnet 11 and causes magnet 11 and cantilever 10 to rotate clockwise until contact 13 touches contact 41 on the right-hand side, closing the electrical conduction path between contact 13 and contact 41. On the other hand, when the direction of the current in coil 20 is opposite to the direction shown in FIGS. 1A and 1B, the magnetic torque ($\tau$) on first magnet 11 is counterclockwise and causes magnet 11 and cantilever 10 to rotate counterclockwise until contact 14 touches contact 42 on the left-hand side, closing the electrical conduction path between contact 14 and contact 42 and opening the electrical conduction path between contact 13 and contact 41. Soft magnetic layers 31 and 32 wrap around coil 20 to form a closed magnetic circuit and enhance the coil-induced magnetic flux density (third vertical magnetic field) in the cantilever region. Openings 36 in soft magnet layers 31 and 32 can be used to reduce the magnetic attraction between the magnetic poles of first magnet 11 and soft magnetic layers 31 and 32. Alternatively, openings 36 can be replaced with a raised or lowered contour in soft magnet 31 and 32 near the ends of magnet 11 to adjust the magnetic attractive force between the magnetic poles of first magnet 11 and soft magnetic layers 31 and 32. When electromagnet 20 is not energized, cantilever can be in the neutral (leveled) position and maintained in that position by the restoring spring force of spring and support 12 and pivot 15, or remained in one of the tilted states (one end down) when the magnetic attraction between that end of magnet 11 and soft magnetic layers 31 and 32 is strong enough to hold it there.

Some of the aforementioned advantages of the disclosed invention can be evidenced by the following examples.

EXAMPLE 1

The first magnet having the following characteristics: length=4 mm (along long axis), width=4 mm, thickness=0.2 mm, volume V=length×width×thickness, remnant magnetization $B_r=\mu_0 M=1$ T, the magnetic moment $\mu_0 m=\mu_0 M\times V=3.2\times10^{-9}$ T·m$^3$. For a coil-induced magnetic field $\mu_0 H_s=0.05$ T ($H_s$=500 Oe), the induced magnetic torque about the length center is $\tau=\mu_0 m\times H_s=1.27\times10^{-4}$ m·N (m is perpendicular to $H_s$) which corresponds to a force of $F_m=\tau/(\text{length}/2)=6.4\times10^{-2}$ N at the end of the first magnet. The above exemplary parameters show that for a relatively small coil-induced magnetic field ($H_s$=500 Oe), a significantly large torque and force can be generated. The torque and force can continue to increase with larger $H_s$ (correspondingly larger coil current). When the angle between m and $H_s$ changes from perfectly perpendicular (90°) to 80°, the change in the magnitude of the torque (and force) is only 1.5%=1−98.5%=1−sin(80°), which gives a larger tolerance in production variations, simplifies the production process, and reduces costs.

FIGS. 2A and 2B show another exemplary embodiment of an electromechanical relay. In this embodiment, relay 200 comprises a movable cantilever 10, a coil 20, soft magnetic layers 31 and 32 with suitable openings 36, and electrical contacts 41 and 42.

With continued reference to FIGS. 1A and 2B, movable cantilever 10 comprises a permanent (hard) magnetic layer 11 (first magnet), flexure spring and support 12, and electrical contacts 13 and 14. Magnetic layer 11 is permanently magnetized (with a magnetic moment m) primarily through its thickness (e.g., predominantly along the positive y-axis when it lies leveled). Other magnetization orientation of magnetic layer 11 can be used to achieve the function and purpose of this invention. Cantilever 10 has a first (right) end associated with the first (right) end of first magnet 11 and contact 13, and has a second (left) end associated with the second (left) end of first magnet 11 and contact 14. Magnetic layer 11 can be any type of hard magnetic material that can retain a remnant magnetization in the absence of an external magnetic field and its remnant magnetization cannot be easily demagnetized. Flexure spring and support 12 can be any flexible material that on one hand supports cantilever 10 and on the other allows cantilever 10 to be able to move and rotate. Flexure spring and support 12 can be made of metal layers (such as Beryllium Copper, Ni, stainless steel, etc.), or non-metal layers (such as polyimide, Si, $Si_3Ni_4$, etc.). The flexibility of the flexure spring can be adjusted by its thickness, width, length, shape, and elasticity, etc. A pivot can be used to further support the cantilever. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of the cantilever by electroplating, deposition, welding, lamination, or any other suitable means. Flexure spring and support 12 and electrical contacts 13 and 14 can be formed by either using one process and the same material, or by using multiple processes, multiple layers, and different materials. When the cantilever rotates and its two ends move up or down, electrical contact 13 or 14 either makes or breaks the electrical connection with the bottom contact 41 or 42. Optional insulating layers (not shown) can be placed between the conducting layers to isolate electrical signals in some cases.

Coil 20 (third electromagnet) can be formed by having multiple windings of conducting wires around cantilever 10. The conducting wires can be any conducting materials such as Cu, Al, Au, or others. The windings can be formed by either winding the conducting wires around a bobbin, or by electroplating, deposition, etching, laser forming, or other means used in electronics industry (e.g., semiconductor integrated circuits, printed circuit boards, etc.). Coil 20 in relay 200, when energized, provides a third horizontal (x-axis) magnetic field ($H_s$) so that a magnetic torque ($\tau=\mu_0 m\times H_s$) can be created on cantilever 10. Because magnetic moment m is fixed, the direction and magnitude of the torque depends on the direction and magnitude of the current in coil 20.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. Soft magnetic layers 31 and 32 forms a closed magnetic circuit and enhances the coil-induced magnetic flux density (third vertical magnetic field) in the cantilever region. Soft magnetic layers 31 and 32 can cause an attractive force between the pole of hard magnetic layer 11 and the induced local opposite magnetic pole of the soft magnetic layer so that a stable contact force can be maintained between electrical contact 13 (or 14) and electrical contact 41 (or 42). Soft magnetic layers 31 and 32 can also confine the magnetic field inside the cavity enclosed by soft magnetic layers 31 and 32 so that the magnetic interference between adjacent devices can be eliminated or reduced. Openings 36, which effectively increase the distance between soft magnetic layer 31 (and/or 32) and the ends of first magnet 11, can be suitably formed as recessed contours in soft magnetic layers 31 (and/or 32) to reduce the attractive force between the magnetic poles of magnet 11 and the soft magnetic layers 31 and 32.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on a substrate 33 by electroplating, deposition, welding, lamination, or any other suitable means. Optional insulating layers (not shown) can be placed between the conducting layers to isolate electrical signals in some cases. Transmission-line types of contacts and metal traces can also be suitably designed and formed for high performance radio-frequency applications.

Energizing (passing a current in) electromagnet 20 produces a third magnetic field which can be primarily perpendicular to the magnetization direction of first movable magnet 11 and exerts a magnetic torque on first magnet 11 to force first magnet 11 and cantilever 10 to rotate and close an electrical conduction path at one end (e.g., first end) of cantilever 10. In the illustration shown in FIG. 2B, the current flows into the paper (circle with a cross) below cantilever 10 and out from the paper (circle with a dot) above cantilever 10, and the produced third magnetic field $H_s$ is along the positive x-axis and the magnetic torque ($\tau=\mu_0 m \times H_s$) on magnet 11 is clockwise. Changing the direction of the electrical current in third electromagnet 20 changes the direction of the third magnetic field and thus the direction of the magnetic torque on first magnet 11, and causes first magnet 11 and cantilever 10 to rotate in an opposite direction and opens the electrical conduction path at one end (e.g., first end) of cantilever 10 and closes the electrical conduction path at the other end (e.g., second end).

FIG. 3 shows another exemplary embodiment of an electromechanical relay in the form of a double-pole-double-throw relay. In this embodiment, relay 300 comprises a movable cantilever 10 and a movable cantilever 50, a coil 20, soft magnetic layers 31 and 32, and electrical contacts 41, 42, 61, and 62 placed on a substrate 33.

With continued reference to FIG. 3, movable cantilever 10 comprises a permanent (hard) magnetic layer 11 (first magnet), flexure spring and support 12, a pivot 15, and electrical contacts 13 and 14. Movable cantilever 50 comprises a permanent (hard) magnetic layer 51 (fourth magnet), flexure spring and support 52, a pivot 55, and electrical contacts 53 and 54. Magnetic layer 11 is permanently magnetized (with a magnetic moment m) primarily along its long axis (e.g., predominantly along the positive x-axis when it lies leveled). Fourth magnetic layer 51 is permanently magnetized (with a magnetic moment $m_2$) primarily along its long axis (e.g., predominantly along the negative x-axis when it lies leveled). Other magnetization orientations of magnetic layers 11 and 51 can be also used to achieve the function and purpose of this invention. In some cases, one of the movable bodies (cantilever 10 or cantilever 50) can be fixed and the other be allowed to move or rotate in response to the torque produced by third magnet 20.

In the exemplary embodiment shown in FIG. 3, opposite (e.g., north and south) magnetic poles are arranged at the same ends (e.g., right ends) of the two magnetic layers (11 and 51), so that the same ends (e.g., right ends) are attracted to each other. When the opposite magnetic poles are closer to each other on one side (e.g., right side) than the other (e.g., left side), the attractive magnetic force between magnets 11 and 51 on that side (e.g., right side) is larger than the attractive force between magnets 11 and 51 on the other side (e.g., left side), so that contact 13 is forced to touch contact 41 and contact 53 is forced to touch contact 61, forming stable closed states on the right side of cantilevers 10 and 50. Similarly, stable closed states on the left side of cantilevers 10 and 50 can be formed when the left ends of magnets 11 and 51 approach each other and generate a larger attractive force between magnets 11 and 51 on the left side than that on the right side. To switch the cantilevers from one stable state to the other can be achieved by passing a current pulse through coil 20, which in turn produces a third magnetic field $H_s$ primarily perpendicular to the magnetization directions of magnets 11 and 51 when they are in the leveled position. Third magnetic field $H_s$ exerts a torque $\tau$ ($\tau=\mu_0 m \times H_s$) on magnet 11 and a torque $\tau_2$ ($\tau_2=\mu_0 m_2 \times H_s$) on magnet 51, causing both magnets to rotate. In the illustration shown in FIG. 3, magnetic torque $\tau$ is counterclockwise and magnetic torque $\tau_2$ is clockwise. When the magnetic torques generated by third magnetic field $H_s$ are large enough to overcome the attractive force between magnets 11 and 51 on the right side, cantilever 10 will rotate counterclockwise and cantilever 51 will rotate clockwise until the left contacts are closed and right contacts are open. Reversing the current pulse in coil 20 can reverse the directions of torques $\tau$ and $\tau_2$ and switch cantilevers 10 and 50 to the right-side closed state.

FIG. 4 shows another exemplary embodiment of an electromechanical relay. In this embodiment, relay 400 comprises a movable cantilever 10 and a movable cantilever 70, a coil 20, soft magnetic layers 31 and 32 (with openings 36), and electrical contacts 61, and 62 placed on a substrate 33.

With continued reference to FIG. 4, movable cantilever 10 comprises a permanent (hard) magnetic layer 11 (first magnet), flexure spring and support 12, and a pivot 15. Movable cantilever 70 comprises a soft magnetic layer 71 (fourth magnet), flexure spring and support 72 (not shown), a pivot 55, and electrical contacts 73 and 74. Magnetic layer 11 is permanently magnetized (with a magnetic moment m) primarily along its long axis (e.g., predominantly along the positive x-axis when it lies leveled). The magnetic moment $m_3$ in fourth magnet 71 is induced by first magnet 11. Cantilever 70 and contacts 61 and 62 can be in a completely sealed compartment separate from the compartment housing cantilever 10 and coil 20 as shown in FIG. 4. When the right end of magnet 11 approaches cantilever 70, it attracts the right end of soft magnet 71 and causes contact 73 to touch contact 61, forming a stable closed state on the right side of cantilever 70. A stable closed state on the left side (and open state on the right side) of cantilever 70 can be formed when the left side of magnet 11 approaches cantilever 70. To switch cantilever 70 between the states can be accomplished by passing a short current pulse through coil 20 to generate an appropriate torque $\tau$ on magnet 11 and cause magnet 11 and subsequently magnet 71 to rotate to the desired state. In this exemplary embodiment, magnet 11 acts as a master actuator and magnet 71 acts as a responding slave. In some cases, one of the movable bodies (cantilever 10 or cantilever 70) can be fixed and the other be allowed to move or rotate in response to the torque produced by third magnet 20.

It is understood that a variety of methods can be used to fabricate the electromechanical relay. These methods include, but not limited to, semiconductor integrated circuit fabrication methods, printed circuit board fabrication methods, micro-machining methods, and so on. The methods include processes such as photo lithography for pattern definition, deposition, plating, screen printing, etching, lamination, molding, welding, adhering, bonding, and so on. The detailed descriptions of various possible fabrication methods are omitted here for brevity.

It will be understood that many other embodiments and combinations of different choices of materials and arrangements could be formulated without departing from the scope of the invention. Similarly, various topographies and geometries of relay 100 could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

REFERENCE

[1] Engineers' Relay Handbook, 5th Edition, published by National Association of Relay Manufacturers, 1996.
[2] U.S. Pat. No. 5,818,316, Shen et al.
[3] U.S. Pat. No. 6,469,602 B2, Ruan and Shen.
[4] U.S. Pat. No. 6,124,650, Bishop et al.
[5] U.S. Pat. No. 6,469,603 B1, Ruan and Shen.
[6] U.S. Pat. No. 5,398,011, Kimura et al.
[7] U.S. Pat. No. 5,847,631, Taylor and Allen.
[8] U.S. Pat. No. 6,094,116, Tai et al.
[9] U.S. Pat. No. 6,084,281, Fullin et al.
[10] U.S. Pat. No. 5,475,353, Roshen et al.
[11] U.S. Pat. No. 5,703,550, Pawlak et al.
[12] U.S. Pat. No. 5,945,898, Judy et al.
[13] U.S. Pat. No. 6,143,997, Feng et al.
[14] U.S. Pat. No. 6,794,965 B2, Shen et al.
[15] U.S. Pat. No. 7,482,899 B2.

What is claimed is:

1. A magnetic device, comprising:

a substrate (33):

a first movable body (10) attached to said substrate having a first rotational axis, said first movable body having at least a first end (13) and comprising a first permanent magnet (11) having a first magnetic field and a permanent magnetization moment;

a second movable body (50, or 70) placed in proximity to said first movable body, said second Movable body having a second rotational axis and at least a third end (53, or 73); said first and second movable bodies arc arranged in such a way whereby said first end is attracted to said third end; or said first end repels said third end;

a third magnet (20) having a single coil encaging said first movable body, wherein passing a current through said coil generating a third magnetic field passing through the whole body of said first permanent magnet and said third magnetic field comprising a main component primarily perpendicular to said permanent magnetization moment whereby the vector-cross product of said third magnetic field and said permanent magnetization moment producing a torque on said first permanent magnet and causing said first movable body to rotate about said first rotational axis and causing said second movable body to rotate about said second rotational axis; wherein said third magnet is controllable to cause said first movable body and second movable body to settle in at least one stable state related to said substrate.

2. A magnetic device according to claim 1, wherein said at least one stable state is selected from:

a) a first stable configuration wherein said first movable body (10) is rotated such that said first end (13) of said first movable body is moved toward said substrate and said second movable body (50, or 70) is rotated such that said third end (53, or 73) of said second movable body is moved toward said substrate;

b) a second stable configuration wherein said first movable body is rotated such that said first end of said first movable body is moved away from said substrate and said second movable body is rotated such that said third end of said second movable body is moved away from said substrate.

3. A magnetic device according to claim 1, wherein said second movable body (70) comprises soft magnetic material (71).

4. A magnetic device according to claim 1, wherein said second movable body (50) comprises hard magnetic material (51).

5. A magnetic device according to claim 2, wherein said first movable body (10) comprises a first electrical contract (13) and said substrate comprises a third electrical contact (41); and said second movable body (50, or 70) comprises a fifth electrical contact (53, or 73) and said substrate comprises a sixth electrical contact (61).

6. A magnetic device according to claim 5 wherein said first stable configuration corresponds to said first electrical contact (13) being electrically coupled to said third electrical contact (41), and said fifth electrical contact (53, or 73) being electrically coupled to said sixth electrical contact (61).

7. A magnetic device according to claim 5 wherein said second stable configuration corresponds to said first electrical contact (13) being electrically de-coupled to said third electrical contact (41), and said fifth electrical contact (53, or 73) being electrically de-coupled to said sixth electrical contact (61).

8. A magnetic device according to claim 1 wherein said substrate comprises a second soft magnetic element (31).

9. A magnetic device according to claim 2 wherein said substrate comprises a second soft magnetic element (31).

10. A magnetic device according to claim 9 wherein said first permanent magnet (11) is attracted to second soft magnetic element (31) such that said first movable body (10) remains in said first stable configuration in absence of said third magnetic field.

11. A magnetic device according to claim 9 wherein said first permanent magnet (11) is attracted to second soft magnetic element(31) such that said first movable body (10) remains in said second stable configuration in absence of said third magnetic field.

12. A magnetic device according to claim 8 wherein said second soft magnetic element (31) having non-planar features (36) near said first end (13) of first movable body (10), wherein said non-planar features are placed to adjust the magnetic attraction between said first permanent magnet (11) and said second soft magnetic element (31).

13. A magnetic device according to claim 8 wherein said second soft magnetic element having non-planar features (36) near a second end (14) of first movable body (10), wherein said non-planar features are placed to adjust the magnetic attraction between said first permanent magnet (11) and said second soft magnetic element (31).

14. A magnetic device according to claim 3 wherein said first permanent magnet (11) is attracted to said soft magnetic material in said second movable body such that a stable configuration is maintained in absence of said third magnetic field, wherein in said stable configuration said first movable body (10) is rotated such that said first end (13) of said first movable body is moved toward said substrate and said second movable body (70) is rotated such that said third end (73) of said second movable body is moved toward said substrate.

15. A magnetic device according to claim 3 wherein said first permanent magnet (11) is attracted to said soft magnetic material (71) in said second movable body (70) such that a stable configuration is maintained in absence of said third magnetic field, wherein in said stable configuration said first movable body (10) is rotated such that said first end (13) of said first movable body is moved away from said substrate and said second movable body (70) is rotated such that said third end (73) of said second movable body (70) is moved away from said substrate.

16. A magnetic device according to claim 4 wherein said first permanent magnet (11), is attracted to said hard magnetic material (51) in said second movable body (50) such that a stable configuration is maintained in absence of said third magnetic field, wherein in said stable configuration said first movable body (10) is rotated such that said first end (13) of said first movable body is moved toward said substrate and said second movable body (50) is rotated such that said third end (53) of said second movable body is moved toward said substrate.

17. A magnetic device according claim 4 wherein said first permanent magnet (11) is attracted to said hard magnetic material (51) in said second movable body (50) such that a stable configuration is maintained in absence of said third magnetic field, wherein in said stable configuration said first movable body is rotated such that said first end (13) of said first movable body is moved away from said substrate and said second movable body is rotated such that said third end (53) of said second movable body is moved away from said substrate.

18. A magnetic device according to claim 1 wherein said magnetic device is an electromechanical relay.

19. A magnetic device, comprising:

a substrate (33);

a first movable body (10) attached to said substrate having a first rotational axis, said first movable body having at least a first end (13) and comprising a first permanent (11) magnet having a first magnetic field and a permanent magnetization moment;

a second soft magnetic element (31) having non-planar structures (36) near at least one end (13, or 14) of said first movable body;

a third magnet (20) having a single coil encasing said first movable body, wherein passing a current through said coil generating a third magnetic field passing through the whole body of said first permanent magnet and said third magnetic field comprising a main component primarily perpendicular to said permanent magnetization moment whereby the vector-cross product of said third magnetic field and said permanent magnetization moment producing a torque on said first permanent magnet and causing said first movable body to rotate about said first rotational axis; wherein said third magnet is controllable to cause said first movable body to settle in at least one stable state related to said substrate.

20. A magnetic device according to claim 19, wherein said at least one stable state is selected from:

a) a first stable configuration wherein said first movable body is rotated such that said first end of said first movable body is moved toward said substrate;

b) a second stable configuration wherein said first movable body is rotated such that said first end of said first movable body is moved away from said substrate.

* * * * *